US007351327B2

(12) United States Patent
Podrebarac et al.

(10) Patent No.: US 7,351,327 B2
(45) **Date of Patent: *Apr. 1, 2008**

(54) PROCESS FOR THE SELECTIVE DESULFURIZATION OF A MID RANGE GASOLINE CUT

(75) Inventors: Gary G. Podrebarac, Houston, TX (US); Willibrord A. Groten, Houston, TX (US); Lawrence A. Smith, Jr., Houston, TX (US)

(73) Assignee: Catalytic Distillation Technologies, Pasadena, TX (US)

( * ) Notice: Subject to any disclaimer, the term of this patent is extended or adjusted under 35 U.S.C. 154(b) by 209 days.

This patent is subject to a terminal disclaimer.

(21) Appl. No.: 10/820,399

(22) Filed: Apr. 7, 2004

(65) Prior Publication Data

US 2004/0195151 A1 Oct. 7, 2004

Related U.S. Application Data

(63) Continuation of application No. 10/093,880, filed on Mar. 8, 2002, now Pat. No. 6,824,676.

(51) Int. Cl.
*C10G 45/04* (2006.01)
*C10G 45/32* (2006.01)

(52) U.S. Cl. ..... 208/218; 209/211; 209/212; 209/213; 209/210; 585/259; 585/260; 585/264

(58) Field of Classification Search ..... 208/210, 208/209, 211, 212, 213, 218; 585/259, 260, 585/264

See application file for complete search history.

(56) References Cited

U.S. PATENT DOCUMENTS

| | | | | |
|---|---|---|---|---|
| 3,691,066 | A | 9/1972 | Carruthers et al. | 208/255 R |
| 4,055,483 | A | 10/1977 | Mertzweiller et al. | 208/213 |
| 4,194,964 | A | 3/1980 | Chen et al. | 208/108 |
| 4,486,297 | A | 12/1984 | Matsumoto et al. | 208/211 |
| 4,731,229 | A | 3/1988 | Sperandio | 422/188 |
| 5,073,236 | A | 12/1991 | Gelbein et al. | 203/29 |
| 5,321,163 | A | 6/1994 | Hickey et al. | 568/59 |
| 5,431,888 | A | 7/1995 | Hickey et al. | 422/191 |
| 5,510,568 | A | 4/1996 | Hearn | 585/834 |
| 5,597,476 | A | 1/1997 | Hearn et al. | 208/208 R |
| 5,659,106 | A | 8/1997 | Frey et al. | 585/803 |
| 5,779,883 | A | 7/1998 | Hearn et al. | 208/213 |
| 5,807,477 | A | 9/1998 | Hearn et al. | 208/238 |
| 6,083,378 | A | 7/2000 | Gildert et al. | 208/209 |
| 6,444,118 | B1 | 9/2002 | Podrebarac et al. | 208/210 |
| 6,824,676 | B1 * | 11/2004 | Podrebarac et al. | 208/210 |
| 2003/0136706 | A1 | 7/2003 | McDaniel et al. | 208/97 |

FOREIGN PATENT DOCUMENTS

| | | |
|---|---|---|
| EP | 0 725 126 A1 | 8/1996 |

* cited by examiner

*Primary Examiner*—Tam M. Nguyen
(74) *Attorney, Agent, or Firm*—Osha Liang LLP

(57) ABSTRACT

A process for concurrently fractionating and treating a full range naphtha stream. The full boiling range naphtha stream is first subjected to simultaneous thioetherification and splitting into a light boiling range naphtha, an intermediate boiling range naphtha and a heavy boiling range naphtha. The intermediate boiling range naphtha containing thiophene and thiophene boiling range mercaptans is passed on to a polishing hydrodesulfurization reactor where a low sulfur, low olefin gas oil is concurrently fed to the polishing reactor to insure that a liquid phase is present.

1 Claim, 1 Drawing Sheet

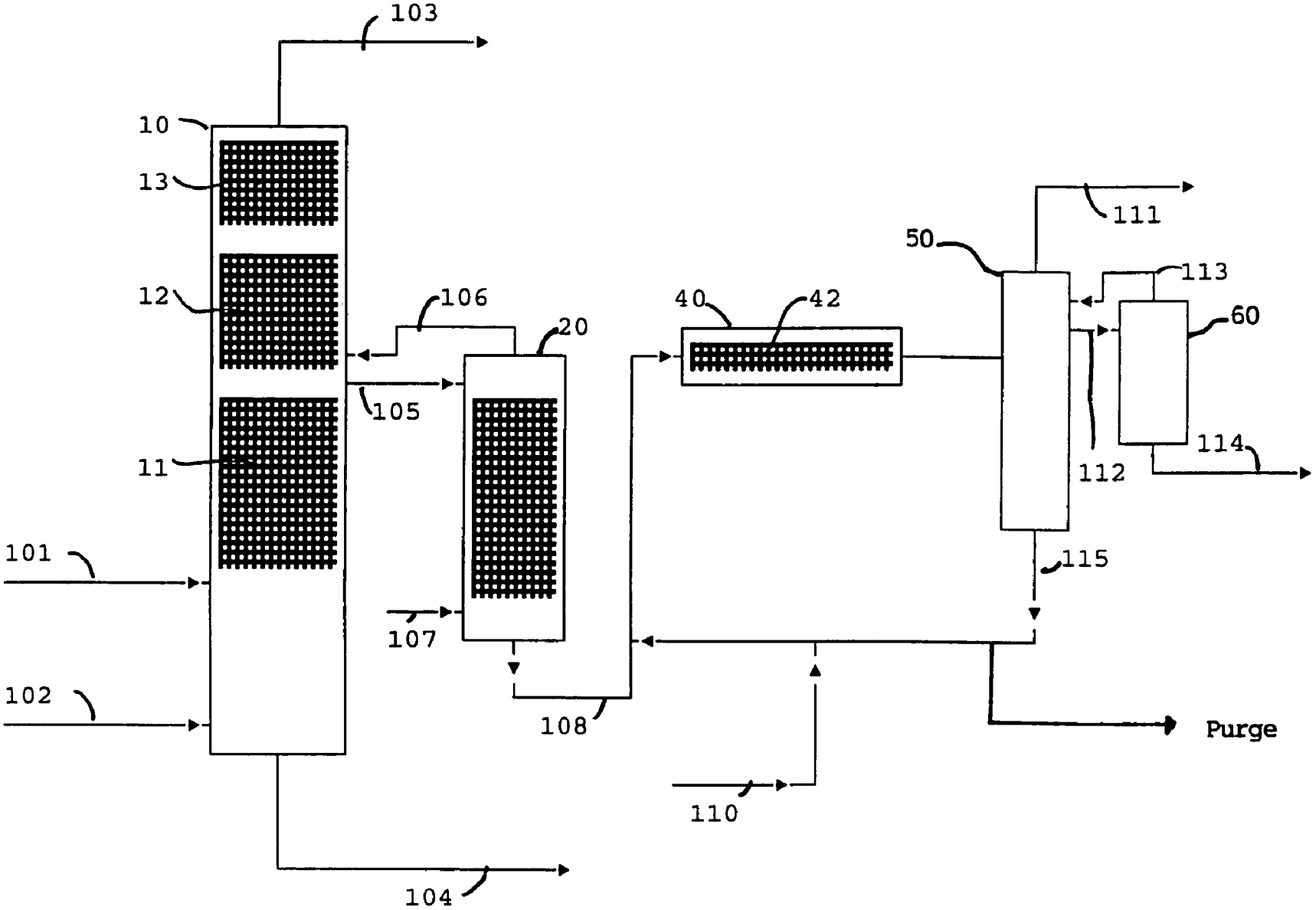
Purge
60
113
114
111
112
115
50
42
40
110
108
20
106
105
107
103
104
10
13
12
11
101
102

PROCESS FOR THE SELECTIVE DESULFURIZATION OF A MID RANGE GASOLINE CUT

This is a continuation of application Ser. No. 10/093,880 filed on Mar. 8, 2002, now U.S. Pat. No. 6,824,676.

BACKGROUND OF THE INVENTION

1. Field of the Invention

The present invention relates to a process for concurrently fractionating and hydrotreating a full range naphtha stream. More particularly the full boiling range naphtha stream is subjected to simultaneous thioetherification and splitting into a light boiling range naphtha, a medium boiling range naphtha and a heavy boiling range naphtha. Each boiling range naphtha is treated separately to achieve a combined desired total sulfur content. More particularly the medium boiling range fraction, containing thiophenic compounds, is subjected to higher severity treatment to selectively remove the sulfur compounds.

2. Related Information

Petroleum distillate streams contain a variety of organic chemical components. Generally the streams are defined by their boiling ranges which determine the compositions. The processing of the streams also affects the composition. For instance, products from either catalytic cracking or thermal cracking processes contain high concentrations of olefinic materials as well as saturated (alkanes) materials and polyunsaturated materials (diolefins). Additionally, these components may be any of the various isomers of the compounds.

The composition of untreated naphtha as it comes from the crude still, or straight run naphtha, is primarily influenced by the crude source. Naphthas from paraffinic crude sources have more saturated straight chain or cyclic compounds. As a general rule most of the "sweet" (low sulfur) crudes and naphthas are paraffinic. The naphthenic crudes contain more unsaturates and cyclic and polycyclic compounds. The higher sulfur content crudes tend to be naphthenic. Treatment of the different straight run naphthas may be slightly different depending upon their composition due to crude source.

Reformed naphtha or reformate generally requires no further treatment except perhaps distillation or solvent extraction for valuable aromatic product removal. Reformed naphthas have essentially no sulfur contaminants due to the severity of their pretreatment for the process and the process itself.

Cracked naphtha as it comes from the catalytic cracker has a relatively high octane number as a result of the olefinic and aromatic compounds contained therein. In some cases this fraction may contribute as much as half of the gasoline in the refinery pool together with a significant portion of the octane.

Catalytically cracked naphtha gasoline boiling range material currently forms a significant part (=⅓) of the gasoline product pool in the United States and it provides the largest portion of the sulfur. The sulfur impurities may require removal, usually by hydrotreating, in order to comply with product specifications or to ensure compliance with environmental regulations.

The most common method of removal of the sulfur compounds is by hydrodesulfurization (HDS) in which the petroleum distillate is passed over a solid particulate catalyst comprising a hydrogenation metal supported on an alumina base. Additionally copious quantities of hydrogen are included in the feed. The following equations illustrate the reactions in a typical HDS unit:

$$RSH+H_2 \rightarrow RH+H_2S \quad (1)$$

$$RCl+H_2 \rightarrow RH+HCl \quad (2)$$

$$2RN+4H_2 \rightarrow 2RH+2NH_3 \quad (3)$$

$$ROOH+2H_2 \rightarrow RH+2H_2O \quad (4)$$

Typical operating conditions for the HDS reactions are:

| | |
|---|---|
| Temperature, ° F. | 600-780 |
| Pressure, psig | 600-3000 |
| $H_2$ recycle rate, SCF/bbl | 1500-3000 |
| Fresh $H_2$ makeup, SCF/bbl | 700-1000 |

After the hydrotreating is complete the product may be fractionated or simply flashed to release the hydrogen sulfide and collect the now desulfurized naphtha.

In addition to supplying high octane blending components the cracked naphthas are often used as sources of olefins in other processes such as etherifications. The conditions of hydrotreating of the naphtha fraction to remove sulfur will also saturate some of the olefinic compounds in the fraction reducing the octane and causing a loss of source olefins.

Various proposals have been made for removing sulfur while retaining the more desirable olefins. Since the olefins in the cracked naphtha are mainly in the low boiling fraction of these naphthas and the sulfur containing impurities tend to be concentrated in the high boiling fraction the most common solution has been prefractionation prior to hydrotreating. The prefractionation produces a light boiling range naphtha which boils in the range of $C_5$ to about 250° F. and a heavy boiling range naphtha which boils in the range of from about 250-475° F.

The predominant light or lower boiling sulfur compounds are mercaptans while the heavier or higher boiling compounds are thiophenes and other heterocyclic compounds. The separation by fractionation alone will not remove the mercaptans. However, in the past the mercaptans have been removed by oxidative processes involving caustic washing. A combination oxidative removal of the mercaptans followed by fractionation and hydrotreating of the heavier fraction is disclosed in U.S. Pat. No. 5,320,742. In the oxidative removal of the mercaptans the mercaptans are converted to the corresponding disulfides.

In addition to treating the lighter portion of the naphtha to remove the mercaptans it traditionally has been used as feed to a catalytic reforming unit to increase the octane number if necessary. Also the lighter fraction may be subjected to further separation to remove the valuable $C_5$ olefins (amylenes) which are useful in preparing ethers.

More recently a new technology has allowed for the simultaneous treatment and fractionation of petroleum products, including naphtha, especially fluid catalytically cracked naphtha (FCC naphtha). See, for example, commonly owned U.S. Pat. Nos. 5,510,568; 5,597,476; 5,779,883; 5,807,477 and 6,083,378.

In a common embodiment a full boiling range FCC naphtha is fed to a naphtha splitter which contains a thioetherification catalyst in the upper portion of the splitter. Hydrogen is fed to maintain the catalyst in the hydride state. The mercaptans in the light fraction react with the diolefins contained therein (thioetherification) to produce higher boiling sulfides which are removed as bottoms along with the heavy (higher boiling) FCC naphtha. The bottoms are then fed to a second distillation column reactor containing a standard hydrodesulfurization catalyst where the remaining sulfur compounds (including the sulfides produced in the splitter) are converted to $H_2S$ which can be separated as a vapor. Finally the overheads and bottoms from the second column are combined and passed through a polishing reactor to produce a naphtha product with the desired sulfur content of about 50 wppm. In this way the lower boiling olefin containing fraction is not subjected to conditions conducive to the hydrogenation of the olefins contained therein.

It has now been found that the light FCC naphtha cut just below the light fraction also contains mercaptans and a significant amount of thiophenes. The mercaptans in this cut may be removed by the thioetherification, but the thiophenes remain and this cut will not meet sulfur requirements.

It is an advantage of the present invention that the sulfur may be removed from the light olefin portion of the stream to a heavier portion of the stream without any substantial loss of olefins. Substantially all of the sulfur in the heavier portion is converted to $H_2S$ by hydrodesulfurization and easily distilled away from the hydrocarbons. Also the sulfur in the middle cut will be lowered to specification.

SUMMARY OF THE INVENTION

Briefly the present invention is process for removal of sulfur from a full boiling range fluid cracked naphtha stream to meet higher standards for sulfur removal, by splitting the light portion of the stream utilizing a three way naphtha splitter as a distillation column reactor to treat the lightest boiling range naphtha to remove the mercaptans contained therein by thioetherification and treating the components of the naphtha feed with the process that preserves the olefinic while most expediently removing the sulfur compounds. Utilizing a three-way naphtha splitter as a first distillation column reactor to treat the lightest boiling range naphtha to remove the mercaptans contained therein by reaction with diolefins in the naphtha to form sulfides. A mid-cut sidedraw of a thiophene cut is taken from the first distillation column reactor which may be passed directly to a polishing reactor or more preferably fractionated in a second column depending on the constitution of the sidedraw, contacted with a catalyst in the presence of hydrogen to hydrogenate diolefins.

A side draw or thiophene cut is fed to a reactor for polishing reaction to reduce the sulfur content to that desired, i.e., about 50 wppm or less. The polishing reactor may be either a single pass downflow reactor or a catalytic distillation column reactor. In either mode, a low sulfur, low olefin heavy oil type material is preferably fed along with the thiophene cut to maintain a liquid phase in the reactor. The heavy oil is recovered for recycle in the polishing reactor.

The advantages of this system are that the size and capital investment of the hydrodesulfurization distillation column reactor is reduced; the level of recombinant mercaptans coming from the hydrodesulfurization distillation column is reduced, and finally, there is a potential savings in octane due to the milder treatment of the olefin rich thiophene cut.

As used herein the term "distillation column reactor" means a distillation column which also contains catalyst such that reaction and distillation are going on concurrently in the column. In a preferred embodiment the catalyst is prepared as a distillation structure and serves as both the catalyst and distillation structure.

BRIEF DESCRIPTION OF THE DRAWING

The FIGURE is a simplified flow diagram of one embodiment of the invention.

DETAILED DESCRIPTION OF THE INVENTION

The feed to the process comprises a sulfur-containing petroleum fraction which boils in the gasoline boiling range. Feeds of this type include light naphthas having a boiling range of about $C_5$ to 330° F. and full range naphthas having a boiling range of $C_5$ to 420° F. Generally the process is useful on the naphtha boiling range material from catalytic cracker products because they contain the desired olefins and unwanted sulfur compounds. Straight run naphthas have very little olefinic material, and unless the crude source is "sour", very little sulfur.

The sulfur content of the catalytically cracked fractions will depend upon the sulfur content of the feed to the cracker as well as the boiling range of the selected fraction used as feed to the process. Lighter fractions will have lower sulfur contents than higher boiling fractions. The front end of the naphtha contains most of the high octane olefins but relatively little of the sulfur. The sulfur components in the front end are mainly mercaptans and typical of those compounds are: methyl mercaptan (b.p. 43° F.), ethyl mercaptan (b.p. 99° F.), n-propyl mercaptan (b.p. 154° F.), iso-propyl mercaptan (b.p. 135-140° F.), iso-butyl mercaptan (b.p. 190° F.), tert-butyl mercaptan (b.p. 147° F.), n-butyl mercaptan (b.p. 208° F.), sec-butyl mercaptan (b.p. 203° F.), iso-amyl mercaptan (b.p. 250° F.), n-amyl mercaptan (b.p. 259° F.), α-methylbutyl mercaptan (b.p. 234° F.), α-ethylpropyl mercaptan (b.p. 293° F.), n-hexyl mercaptan (b.p. 304° F.), 2-mercapto hexane (b.p. 284° F.), and 3-mercapto hexane (b.p. 135° F.). Typical sulfur compounds found in the heavier boiling fraction include the heavier mercaptans, thiophenes sulfides and disulfides.

The reaction of these mercaptans with diolefins contained within the naphtha is called thioetherification and the products are higher boiling sulfides. A suitable catalyst for the reaction of the diolefins with the mercaptans is 0.4 wt % Pd on 7 to 14 mesh $Al_2O_3$ (alumina) spheres, supplied by United Catalysts Inc., designated as G-68C. Typical physical and chemical properties of the catalyst as provided by the manufacturer are as follows:

TABLE I

| | |
|---|---|
| Designation | G-68C |
| Form | Sphere |
| Nominal size | 7 × 14 mesh |
| Pd. wt % | 0.4 (0.37-0.43) |
| Support | High purity alumina |

Another catalyst useful for the mercaptan-diolefin reaction is 58 wt % Ni on 8 to 14 mesh alumina spheres, supplied by Calcicat, designated as E-475-SR. Typical physical and chemical properties of the catalyst as provided by the manufacturer are as follows:

TABLE II

| | |
|---|---|
| Designation | E-475-SR |
| Form | Spheres |
| Nominal size | 8 × 14 Mesh |
| Ni wt % | 54 |
| Support | Alumina |

The hydrogen rate to the reactor must be sufficient to maintain the reaction which is understood to be the "effectuating amount of hydrogen" as that term is used herein, but kept below that which would cause flooding of the column. The mole ratio of hydrogen to diolefins in the feed is at least 0.5 to 1.0 and preferably 2.0 to 1.0.

The reaction of organic sulfur compounds in a refinery stream with hydrogen over a catalyst to form $H_2S$ is typically called hydrodesulfurization. Hydrotreating is a broader term which includes saturation of olefins and aromatics and the reaction of organic nitrogen compounds to form ammonia. However hydrodesulfurization is included and is sometimes simply referred to as hydrotreating.

Catalysts which are useful for the hydrodesulfurization reaction include Group VIII metals such as cobalt, nickel, palladium, alone or in combination with other metals such as molybdenum or tungsten on a suitable support which may be alumina, silica-alumina, titania-zirconia or the like. Normally the metals are provided as the oxides of the metals supported on extrudates or spheres and as such are not generally useful as distillation structures.

The catalysts contain components from Group V, VIB, VIII metals of the Periodic Table or mixtures thereof. The use of the distillation system reduces the deactivation and provides for longer runs than the fixed bed hydrogenation units of the prior art. The Group VIII metal provides increased overall average activity. Catalysts containing a Group VIB metal such as molybdenum and a Group VIII such as cobalt or nickel are preferred. Catalysts suitable for the hydrodesulfurization reaction include cobalt-molybdenum, nickel-molybdenum and nickel-tungsten. The metals are generally present as oxides supported on a neutral base such as alumina, silica-alumina or the like. The metals are reduced to sulfide either in use or prior to use by exposure to sulfur compound containing streams. The catalyst may also catalyze the hydrogenation of the olefins and polyolefins contained within the light cracked naphtha and to a lesser degree the isomerization of some of the mono-olefins. The hydrogenation, especially of the mono-olefins in the lighter fraction may not be desirable.

The properties of a typical hydrodesulfurization catalyst are shown in Table III below.

TABLE III

| | |
|---|---|
| Manufacture | Criterion Catalyst Co. |
| Designation | C-448 |
| Form | Tri-lobe Extrudate |
| Nominal size | 1.2 mm diameter |
| Metal, Wt. % | |
| Cobalt | 2-5% |
| Molybdenum | 5-20% |
| Support | Alumina |

The catalyst typically is in the form of extrudates having a diameter of 1/8, 1/16 or 1/32 inches and an L/D of 1.5 to 10. The catalyst also may be in the form of spheres having the same diameters. They may be directly loaded into standard single pass fixed bed reactors which include supports and reactant distribution structures. However, in their regular form they form too compact a mass and must then be prepared in the form of a catalytic distillation structure. The catalytic distillation structure must be able to function as catalyst and as mass transfer medium. The catalyst must be suitably supported and spaced within the column to act as a catalytic distillation structure. In a preferred embodiment the catalyst is contained in a woven wire mesh structure as disclosed in U.S. Pat. No. 5,266,546, which is hereby incorporated by reference. More preferably the catalyst is contained in a plurality of wire mesh tubes closed at either end and laid across a sheet of wire mesh fabric such as demister wire. The sheet and tubes are then rolled into a bale for loading into the distillation column reactor. This embodiment is described in U.S. Pat. No. 5,431,890 which is hereby incorporated by reference. Other catalytic distillation structures useful for this purpose are disclosed in U.S. Pat. Nos. 4,731,229, 5,073,236, 5,431,890 and 5,730,843 which are also incorporated by reference.

Reaction conditions for sulfur removal only in a standard single pass fixed bed reactor are in the range of 500-700° F. at pressures of between 400-1000 psig. Residence times expressed as liquid hourly space velocity are generally typically between 1.0 and 10. The naphtha in the single pass fixed bed reaction may be in the liquid phase or gaseous phase depending on the temperature and pressure, with total pressure and hydrogen gas rate adjusted to attain hydrogen partial pressures in the 100-700 psia range. The operation of the single pass fixed bed hydrodesulfurization is otherwise well known in the art.

The conditions suitable for the desulfurization of naphtha in a distillation column reactor are very different than those in a standard trickle bed reactor, especially with regard to total pressure and hydrogen partial pressure. Typical conditions in a reaction distillation zone of a naphtha hydrodesulfurization distillation column reactor are:

| | |
|---|---|
| Temperature | 450-700° F. |
| Total Pressure | 75-300 psig |
| $H_2$ partial pressure | 6-75 psia |
| LHSV of naphtha | about 1-5 |
| $H_2$ rate | 10-1000 SCFB |

The operation of the distillation column reactor results in both a liquid and vapor phase within the distillation reaction zone. A considerable portion of the vapor is hydrogen while a portion is vaporous hydrocarbon from the petroleum fraction. Actual separation may only be a secondary consideration.

Without limiting the scope of the invention, it is proposed that the mechanism that produces the effectiveness of the present process is the condensation of a portion of the vapors in the reaction system which occludes sufficient hydrogen in the condensed liquid to obtain the requisite intimate contact between the hydrogen and the sulfur compounds in the presence of the catalyst to result in their hydrogenation. In particular, sulfur species concentrate in the liquid while the olefins and $H_2S$ concentrate in the vapor allowing for high conversion of the sulfur compounds with low conversion of the olefin species.

The result of the operation of the process in the distillation column reactor is that lower hydrogen partial pressures (and thus lower total pressures) may be used. As in any distillation there is a temperature gradient within the distillation column reactor. The temperature at the lower end of the column contains higher boiling material and thus is at a higher temperature than the upper end of the column. The lower boiling fraction, which contains more easily removable sulfur compounds, is subjected to lower temperatures at the top of the column which provides for greater selectivity, that is, less hydrocracking or saturation of desirable olefinic compounds. The higher boiling portion is subjected to higher temperatures in the lower end of the distillation column reactor to crack open the sulfur containing ring compounds and hydrogenate the sulfur.

It is believed that in the present distillation column reaction is a benefit first, because the reaction is occurring concurrently with distillation, the initial reaction products and other stream components are removed from the reaction zone as quickly as possible reducing the likelihood of side reactions. Second, because all the components are boiling the temperature of reaction is controlled by the boiling point of the mixture at the system pressure. The heat of reaction simply creates more boil up, but no increase in temperature at a given pressure. As a result, a great deal of control over the rate of reaction and distribution of products can be achieved by regulating the system pressure. A further benefit that this reaction may gain from distillation column reactions is the washing effect that the internal reflux provides to the catalyst thereby reducing polymer build up and coking.

Finally, the upward flowing hydrogen acts as a stripping agent to help remove the $H_2S$ which is produced in the distillation reaction zone.

Referring now to the figure a simplified flow diagram in schematic form is shown. Thioetherification catalyst in the form of a catalytic distillation structure is loaded into two beds 11 and 12 of the rectification section of a naphtha splitter 10 configured as a distillation column reactor. The naphtha feed is into the distillation column reactor 10 below the lower bed 12 via flow line 101. Hydrogen is fed into the lower part of the column via flow line 102. The light naphtha is boiled up into the catalyst beds 11 and 12 in the rectification section where the mercaptans react with diolefins in the naphtha to form sulfides which are higher boiling and thus are separated out with the heavy naphtha. The light naphtha may also be subjected to selective hydrogenation of unreacted diolefins and some isomerization in bed 13 at the top of the column. The light naphtha, now lower in sulfur content is removed as overheads via flow line 103. The preferred operating conditions for the thioetherification reactor are as follows:

| | |
|---|---|
| Pressure | 0-250 psig |
| Temperature | 130-3500° F. |
| $H_2$ partial pres. | 0.1-70 psi |
| LHSV | 0.2-5.0 |

The heavy naphtha fraction is taken as bottoms via flow line 104 and is passed on to further hydrodesulfurization to remove organic sulfur as desired.

A side draw from the thioetherification reactor 10 is taken via flow line 105 and fed to a smaller stripping column reactor 20 containing a bed 22 of hydrogenation catalyst in the form of a distillation structure. Hydrogen is fed to this reactor via flow line 107. The remaining diolefins in the fraction are hydrogenated to form mono olefins which are removed with the bottoms in flow line 108. Lighter products are returned to the first distillation reactor 10 as a vapor via flow line 106. The bottoms in flow line 108 are fed to thiophene reactor 40 where the final desired sulfur level is achieved. To keep the catalyst wetted and enhance performance a low sulfur content, low olefin heavy oil such as gas oil, diesel or heavy gasoline is fed via flow line 110. The heavy oil does not vaporize at the temperature within the reactor but absorbs much of the exothermic heat of reaction and thus the temperature gradient is reduced and dilutes the olefins in the feed. Optionally the catalyst bed 22 may be omitted. As another option the entire side draw may be fed directly to thiophene reactor 40.

The effluent from the reactor 40 is passed to a distillation column 50 where the hydrogen and hydrogen sulfide vapors are separated as overheads in flow line 111. The medium range naphtha product is taken as a side draw to a vapor disengaging vessel 60 via flow line 112 wherein the $H_2S$ and hydrogen are separated from the product and returned to the distillation column 50 via flow line 113. The medium range naphtha is taken as bottoms from vessel 60 via flow line 114. The low sulfur gas oil is taken as bottoms from distillation column 50 via flow line 115 and is recycled back to reactor 40. If desired a slip stream of bottoms (not shown) can be taken to prevent build up of heavies in the system.

Hydrogen is generally recycled back to the reactors. Vents may be sufficient to maintain the $H_2S$ levels low enough for the reaction. However, if desired, the recycle gas may be scrubbed using conventional methods to remove the $H_2S$.

EXAMPLE 1

A full range gasoline described in Table A was tested in the thioetherification distillation column reactor. The results are presented in Table B.

TABLE A

Properties of the full range gasoline used for testing.

| ASTM D-3710 | ° F. |
|---|---|
| 10/0 | 84 |
| 10% | 94 |
| 20% | 108 |
| 30% | 147 |
| 40% | 175 |
| 50% | 201 |
| 60% | 230 |
| 70% | 276 |
| 80% | 308 |
| 90% | 350 |
| 95% | 384 |
| Total S | 970 mg/L |
| Bromine No. | 60 |
| Density | .7465 g/cc |
| Total $C_4$'s | 0.09 wt. % |
| Total $C_5$'s | 20.9 wt. % |
| benzene | 1.12 wt. % |
| Total $C_6$'s | 18.8 wt. % |
| | mg/L |
| $H_2S$ | 0 |
| dimethyl sulphide | 0 |
| COS | 0 |
| MeSH | 0 |
| EtSH | 14.83 |
| 1-PrSH | 4.59 |
| 2-PrSH | 4.94 |
| thiophene | 53.82 |
| 2-methylthiophene | 60.32 |
| 3-methylthiophene | 83.54 |
| tetrahydrothiophene | 15.11 |
| propylsulphide | 38.9 |
| benzothiophene | 73.06 |
| unknowns | 167.67 |
| heavy S | 99.7 |

TABLE B

| | |
|---|---|
| Gasoline feed rate (lb/h) | 116 |
| Hydrogen feed rate (scfh) | 3 |
| % of feed recovered overhead | 27.9 |

TABLE B-continued

| | |
|---|---|
| % of feed recovered in side product | 13.9 |
| Operating pressure (psig) | 75 |
| Reflux ratio | 3.5 |
| Upper catalyst bed temperature (° F.) | 258 |
| Lower catalyst bed temperature (° F.) | 291 |
| Sulphur in OH product (ppmw) | 58.2 |
| Sulphur in side product (ppmw) | 495 |
| Sulphur in bottom product (ppmw) | 1900 |
| % of olefins taken overhead | 50.1 |
| % of olefins taken in side product | 18.8 |
| % of thiophene taken overhead | 18.7 |
| % of thiophene taken in side product | 79.7 |
| Ethyl mercaptan conversion (%) | 99.5+ |
| Propyl mercaptan conversion (%) | 99.5+ |

EXAMPLE 2

A 1½" diameter reactor was loaded with 3 lbs of DC-130 catalyst. This is a CoMo-based catalyst supplied by Criterion Catalysts & Technologies. A flow rate of 20 lb/h of the mid-cut describe in TABLE C was blended with 5 lb/h of the heavy gasoline described in TABLE C and fed into the reactor. The results are set out below in TABLE D.

TABLE C

| The mid-cut of the gasoline had the following characteristics: | |
|---|---|
| Mid-Cut of FCC Gasoline: | |
| Sulfur | 290 mg/L |
| BR # | 90.25 g/100 g |
| Density | 0.719 g/cc |
| ASTM D-3710 | |
| Vol % cuts | ° F. |
| ibp | 127 |
| 5% | 140 |
| 10% | 147 |
| 20% | 158 |
| 30% | 162 |
| 40% | 171 |
| 50% | 177 |
| 60% | 183 |
| 70% | 185 |
| 80% | 189 |
| 90% | 196 |
| 95% | 201 |
| fbp | 230 |

The above mid-cut feed was mixed with heavy gasoline stream having the following characteristics:

| | |
|---|---|
| Sulfur | 52 mg/L |
| Br # | 2.5 g/100 g |
| Density | 0.886 g/cc |
| ASTM D-3710 | |
| Vol % cuts | ° F. |
| ibp | 359 |
| 5% | 372 |
| 10% | 384 |
| 20% | 393 |
| 30% | 398 |
| 40% | 406 |
| 50% | 411 |

-continued

| | |
|---|---|
| 60% | 417 |
| 70% | 433 |
| 80% | 446 |
| 90% | 452 |
| 95% | 471 |
| ep | 501 |

TABLE D

| | |
|---|---|
| Pressure (psig) | 200 |
| Average Temp (° F.) | 580 |
| Delta T(F) | 76.6 |
| Outlet Temp (° F.) | 603 |
| Feed S (ppm) | 323 |
| Feed Br # | 73 |
| Hydrogen Rate (scf/bbl) | 364 |
| S Conversion (%) | 90.9 |
| Br # Conversion (%) | 28 |
| Total S in product (ppm) | 30.6 |

EXAMPLE 3

In order to reduce the exotherm and the outlet temperature of the reactor, more of the heavy gasoline was added to the reactor. More dilution helps keep the temperature lower and gave improved selectivity. The final blended material would then be subject to distillation if desired to recycle the heavy cracked naphtha.

TABLE E

| | Feed | Heavy Gasoline | Final Mixed Product |
|---|---|---|---|
| Total S (mg S/L) | 191 | 17.79 | 10.81 |
| Bromine # | 62.86 | 5.01 | 27.77 |
| Density (g/cc) | 0.7197 | 0.8322 | 0.7728 |
| Boiling Range D3710 | | | |
| ibp deg f. | 135 | 237 | 139 |
| 5% pt deg f. | 139 | 259 | 147 |
| 10% pt deg f. | 141 | 278 | 158 |
| 20% pt deg f. | 148 | 285 | 178 |
| 30% pt deg f. | 159 | 319 | 198 |
| 40% pt deg f. | 172 | 329 | 218 |
| 50% pt deg f. | 183 | 341 | 242 |
| 50% pt deg f. | 193 | 355 | 282 |
| 70% pt deg f. | 204 | 374 | 326 |
| 80% pt deg f. | 218 | 396 | 352 |
| 90% pt deg f. | 229 | 413 | 394 |
| 95% pt deg f. | 235 | 432 | 411 |
| fbp deg f. | 357 | 458 | 449 |
| Amount of LCN (lb/h) | 13 | | |
| Amount of HCN (lb/h) | 13 | | |
| WHSV (h-1) | 6.4928118 | | |
| Operating P (psig) | 249.9883 | | |
| Inlet Temp (° F.) | 472.0531 | | |
| Outlet Temp (° F.) | 534.14398 | | |
| $H_2$ Rate (sbf/bbl) | 389.45564 | | |
| S Conv (%) | 90.60% | | |
| Br # Conv (%) | 19.28% | | |
| Final S in mixture (ppm) | 13.988095 | | |

The invention claimed is:

1. A process for removal of sulfur from a full boiling range fluid cracked naphtha stream comprising the steps of:

(a) feeding hydrogen and a full boiling range naphtha feed containing olefins, diolefins, mercaptans, thiophene and other organic sulfur compounds to a distillation column reactor;

(b) concurrently in said distillation column reactor:

(i) reacting a portion of the mercaptans contained within said full boiling range naphtha stream with a portion of the diolefins contained within said full boiling range naphtha stream to produce sulfides and (ii) separating said full boiling range naphtha stream into three fractions by fractional distillation;

(c) removing product from said distillation column reactor comprising a light naphtha containing substantially no mercaptans, sulfides or other organic sulfur compounds as an overheads;

(d) removing an intermediate naphtha as a side draw from said distillation column reactor containing thiophene, diolefins boiling in the range of thiophene and mercaptans boiling in the range of thiophene;

(e) removing a heavy naphtha from said distillation column reactor containing said sulfides and other organic sulfur compounds as a bottoms;

(f) feeding said intermediate naphtha to a single pass fixed bed reactor containing a hydrodesulfurization catalyst where substantially all of any remaining sulfides and other organic sulfur compounds are reacting with hydrogen to form hydrogen sulfide.

* * * * *